US007134579B2

(12) United States Patent
Scheindel

(10) Patent No.: US 7,134,579 B2
(45) Date of Patent: Nov. 14, 2006

(54) RTV SILICONE SPRAY SYSTEM

(75) Inventor: Christian T. Scheindel, Randolph Center, VT (US)

(73) Assignees: Ultramotive Corporation, Bethel, VT (US); Midson Group, Inc., Southington, CT (US)

( * ) Notice: Subject to any disclaimer, the term of this patent is extended or adjusted under 35 U.S.C. 154(b) by 59 days.

(21) Appl. No.: 10/988,682

(22) Filed: Nov. 15, 2004

(65) Prior Publication Data

US 2006/0102661 A1 May 18, 2006

(51) Int. Cl.
*B65D 83/00* (2006.01)

(52) U.S. Cl. ..... 222/402.1; 222/402.22; 222/635

(58) Field of Classification Search ..... 222/402.1, 222/402.2, 402.22, 402.23, 402.25, 402.16, 222/635

See application file for complete search history.

(56) References Cited

U.S. PATENT DOCUMENTS

| | | | | | |
|---|---|---|---|---|---|
| 3,547,317 | A * | 12/1970 | Green | ..... | 222/402.2 |
| 4,597,512 | A * | 7/1986 | Wilmot | ..... | 222/402.2 |
| 4,880,143 | A * | 11/1989 | Murray et al. | ..... | 222/135 |
| 5,027,985 | A * | 7/1991 | Abplanalp | ..... | 222/402.1 |
| 5,190,192 | A * | 3/1993 | Lina et al. | ..... | 222/321.2 |
| 5,605,258 | A * | 2/1997 | Abplanalp | ..... | 222/402.1 |
| 5,632,421 | A * | 5/1997 | Colombo | ..... | 222/402.2 |
| 6,070,770 | A * | 6/2000 | Tada et al. | ..... | 222/635 |
| 6,966,467 | B1 * | 11/2005 | Di Giovanni et al. | ... | 222/402.2 |

* cited by examiner

*Primary Examiner*—Frederick C. Nicolas
(74) *Attorney, Agent, or Firm*—Ira S. Dorman

(57) ABSTRACT

An aerosol spray system for RTV silicone coating materials employs a valve gasket fabricated from a conformable synthetic resinous material that is substantially non-absorbing of moisture, assembled with components that are also moisture-free.

21 Claims, 2 Drawing Sheets

RTV SILICONE SPRAY SYSTEM

BACKGROUND OF THE INVENTION

Room-temperature vulcanizing (RTV) silicone rubber compositions are in widespread use for numerous applications. The cured elastomers exhibit excellent chemical, dielectric, adhesive and physical properties, including toughness, durability and resistance to environmental effects, making them ideally suited as coating and encapsulation materials for waterproofing and other protection (e.g., against corrosion) of electric motors, power system apparatus, metal hardware and structures, oil- and gas-storage tanks, pipes and transport systems, bridges, abutments, roofs, metal barriers, etc. Unlike many other conventional materials, moreover, which are often difficult to prepare, apply, and/or maintain, RTV silicones do not require complex measuring or mixing procedures (which commonly result in products of short or indeterminate pot life), and they do not chalk, flake, peel, embrittle, or otherwise degrade (at least by most mechanisms) over long periods of time. In addition, the low Durometer values that are typically exhibited by RTV silicone rubbers permit ready mechanical penetration, and thus facilitate the use of tools for effecting the removal of coated panels and the like for purposes of maintenance and repair of protected parts and units.

RTV silicone materials normally cure through water-initiated chemical mechanisms, and therefore react and set up quickly upon exposure to ambient moisture. While this property is very advantageous in most circumstances, it also has the adverse effect of precluding, as a practical matter, the use of certain desirable application techniques. Most notably, efforts to package and dispense RTV silicone coating materials in aerosol form have heretofore been frustrated by the formation of cured deposits, on and around valve components, that clog passages and immobilize parts that have been contacted by the silicone material and that become exposed to the atmosphere (e.g., upon initial discharge or during storage, particularly under high humidity conditions); the shelf-life of such packages was no more than a few months, following initial use.

SUMMARY OF THE INVENTION

Accordingly, it is the broad object of the present invention to provide a system for dispensing a moisture-curable coating material in the form of a spray, particularly a room-temperature vulcanizing silicone rubber, wherein and whereby curing of the material on elements of the system is substantially avoided so as to prevent disabling clogging and immobilization of moving parts.

It is a more specific object of the invention to provide an internally pressurized system containing a liquid RTV silicone rubber coating material that cures through a moisture-initiated chemical reaction, which system has an extended shelf-life and is capable of repeated use for discharging quantities of the material in aerosol form.

It has now been found that certain of the foregoing and related objects of the invention are attained by the provision of a system for supplying, to a spray head, a curable coating material and, in particular, a RTV silicone rubber coating material, which system includes a container having an opening to the interior thereof, a quantity of sprayable, moisture-initiated curable coating material contained in the container, and a valve assembly. In one desirable embodiment of the invention the valve assembly comprises: (1) a closure or cover member associated with the opening of the container and having structure thereon for mounting a valve body; (2) a valve body having an upper end portion defining a cavity extending downwardly from a rim portion thereof and dimensioned and configured for seating a movable throttle member therein, and having a lower end portion with a passage in flow communication with the cavity and the container interior, the valve body being attached to the closure member mounting structure with the rim portion thereof disposed proximate an overlying section of the mounting structure; (3) a throttle member seated in the cavity of the valve body for movement between open and closed valve positions and having a sealing portion facing the overlying section of the mounting structure; and (4) sealing means, fabricated from a conformable synthetic resinous material that is substantially non-absorbing of moisture, having a first portion interposed between the overlying section of the mounting structure of the closure member and the rim portion of the upper end portion of the valve body, for providing a permanent gas-tight seal therebetween, and having a second portion disposed to engage the throttle member in the closed valve position for providing a temporary gas-tight seal against the overlying section of the mounting structure, the throttle member being spaced away from the sealing means in the open valve position to permit passage of the coating material from the container to a spray head.

The non-absorbing synthetic resinous material employed as the sealing means will preferably be polyethylene, albeit other resins (such as the ethylene-octene copolymer elastomer available from DuPont Dow Elastomers under the trademark ENGAGE 8407) that do not absorb significant amounts of moisture (preferably meaning virtually no moisture) may be employed if they are sufficiently conformable, under the influence of prevailing forces, to produce effective seals; typically, the sealing means or element will have a Shore D Durometer (hardness) value of about 20 to 55 (ASTM D-2240). Heretofore, the sealing gaskets have conventionally been made from Buna N, neoprene, butyl rubbers, and fluoroelastomers (i.e., VITON), which typically absorb at least about 0.2 to 0.5 percent of moisture, based upon the weight of the resin. The valve body and the throttle member (as well as other components that contact the RTV coating liquid) will usually also be fabricated from a non-absorbing material, but synthetic resinous materials employed will generally be substantially more rigid than those that are used for the sealing element; typically, polypropylene or an acetal resin will be utilized, and a suitable acetal copolymer resin is commercially available from Ticonia Company under the CELCON M90 trade designation. Heretofore, the value body has most commonly been made of nylon, which is of course a moisture-absorbing resin.

In certain preferred embodiments, the overlying section of the mounting structure of the closure member will have an aperture therethrough for passage of the stem portion of an actuating spray head member to permit its operative engagement with the throttle member so as to effect movement thereof. In such embodiments the sealing means employed will desirably take the form of a substantially annular gasket that surrounds the aperture and that has an ID that is sufficiently small to hug the stem portion and thereby produce a sliding seal thereagainst.

The throttle member will normally be slidably seated in the cavity of the valve body, for movement between the open and closed valve positions, and a spring will usually be provided for biasing it to the closed valve position. The throttle member may have a cup-like upper end portion, for seating the stem portion of the actuating spray head member, and a lower end portion constructed for engagement of the spring; the lower end portion of the valve body will usually have means thereon for attaching a tube for delivery of the coating material to the passage thereof.

Most desirably, the coating material employed in the system of the invention will itself be substantially devoid of moisture-absorbing components (e.g., titanium dioxide, carbon black, and other hygroscopic pigments and colorants), unless they are dried to remove virtually all moisture, to which end the coating material will, in many instances, advantageously be substantially clear. It is believed moreover that certain colorants, such as for example polymer-soluble dyes dispersed in liquid hydrocarbon carriers, can be employed without detriment to ongoing utilization of the system, suitable dye powders being available from the Alpha Chem company, of Kings Point, N.Y., under the RESOPLAST trade designation. A suitable RTV coating material is commercially available from the Midsun Group, of Southington, Conn., under the SILPROCOAT trademark, albeit viscosity adjustments will normally be necessary (such as by adding heptane, mineral spirits, or other long-chain hydrocarbons) to render it (or other commercially available RTV coating materials) sprayable, or more optimally so; it will be appreciated that admixture of a liquid propellant with the coating material will also serve to effect viscosity modification.

Other objects of the invention are attained by the provision of an internally pressurized system for dispensing moisture-curable RTV silicone rubber coating material in the form of a spray, including: a container having an opening to the interior thereof; a quantity of sprayable, moisture-curable RTV silicone rubber coating material, and a pressure-generating propellant, contained in the container; a removable spray head actuating member, which includes a spray head disposed outwardly of the container and associated with the opening therein; and a valve arrangement operatively interposed between the spray head and the interior of the container. The valve arrangement includes a valve seat adjacent the opening of the container, a throttle member having a sealing portion, means mounting the throttle member for movement between open and closed valve positions, with the sealing portion thereof facing the valve seat for cooperation therewith, and sealing means fabricated from a conformable synthetic resinous material that is, like the materials used to fabricate other parts that contact the coating material, substantially non-absorbing of moisture. The sealing means is disposed between the valve seat and the throttle member so as to engage the sealing portion of the throttle member in the closed valve position, and thereby provide a temporary gas-tight seal for preventing passage of the coating material from the container interior to the spray head. The spray head actuating member has an actuating element in operative engagement with the throttle member for effecting displacement thereof from the closed valve position, enabling controlled flow of the coating material from the container interior to the spray head.

DETAILED DESCRIPTION OF THE ILLUSTRATED EMBODIMENTS

Figure 1:
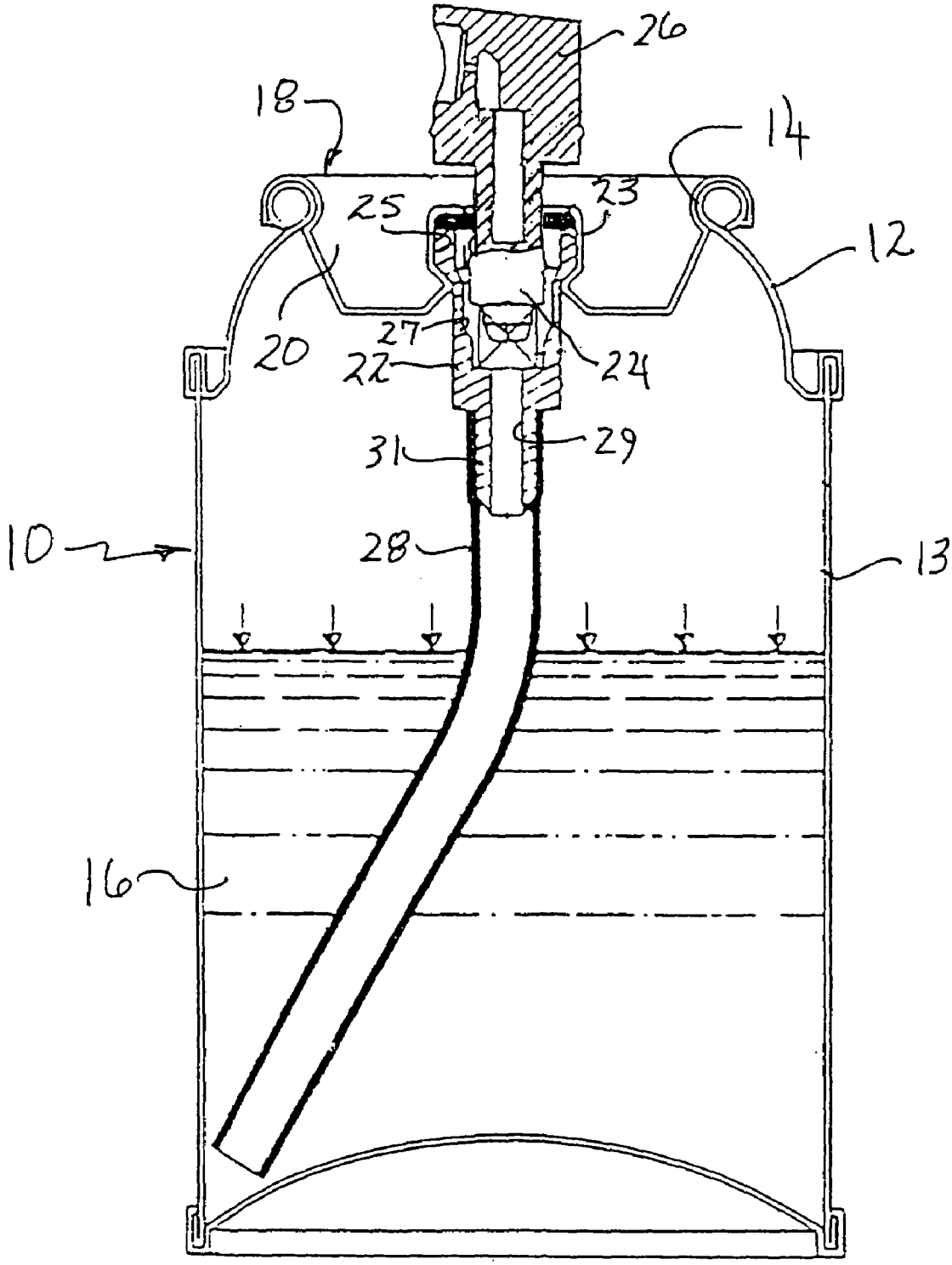
FIG. 1 is a diagrammatic cross-sectional view of an aerosol system embodying the present invention.

Turning now in detail to FIG. 1 of the drawings, therein illustrated is a pressurized aerosol system which is, except as pointed out hereinafter, of conventional design and construction. More particularly, the aerosol system consists of a can or container, generally designated by the numeral 10, comprised of a dome-like top wall 12 attached by a seam to the upper edge of a sidewall 13, the top wall 12 defining a circular opening 14 into the can 10. A quantity of sprayable, moisture-initiated RTV liquid silicone coating material 16 (which may comprise a liquid propellant ingredient) is contained in the can 10 and is (as indicated by the downwardly directed arrows) pressurized by a head of propellant vapor; typical conventional propellants include butane, propane, carbon dioxide, nitrous oxide, and tetrafluoroethane (e.g., DuPont 134A).

A so-called "female" valve assembly includes a closure or cover member (mounting cover, or cup), generally designated by the numeral 18, having a depending central portion 20 received in the circular opening 14 of the top wall 12, and having an upstanding portion 23 that defines an inwardly opening recess 25 in which is mounted the upper end portion of a valve body 22. A throttle member 24 is seated within a cavity 27 of the valve body 22 for slidable movement, actuated by a spray head 26, and a dip tube 28 (typically made of low-density polyethylene) serves to deliver the liquid silicone material 16 to the valve body 22, flowing into the cavity 27 through the passage 29 in the nipple portion 31.

Figure 2:
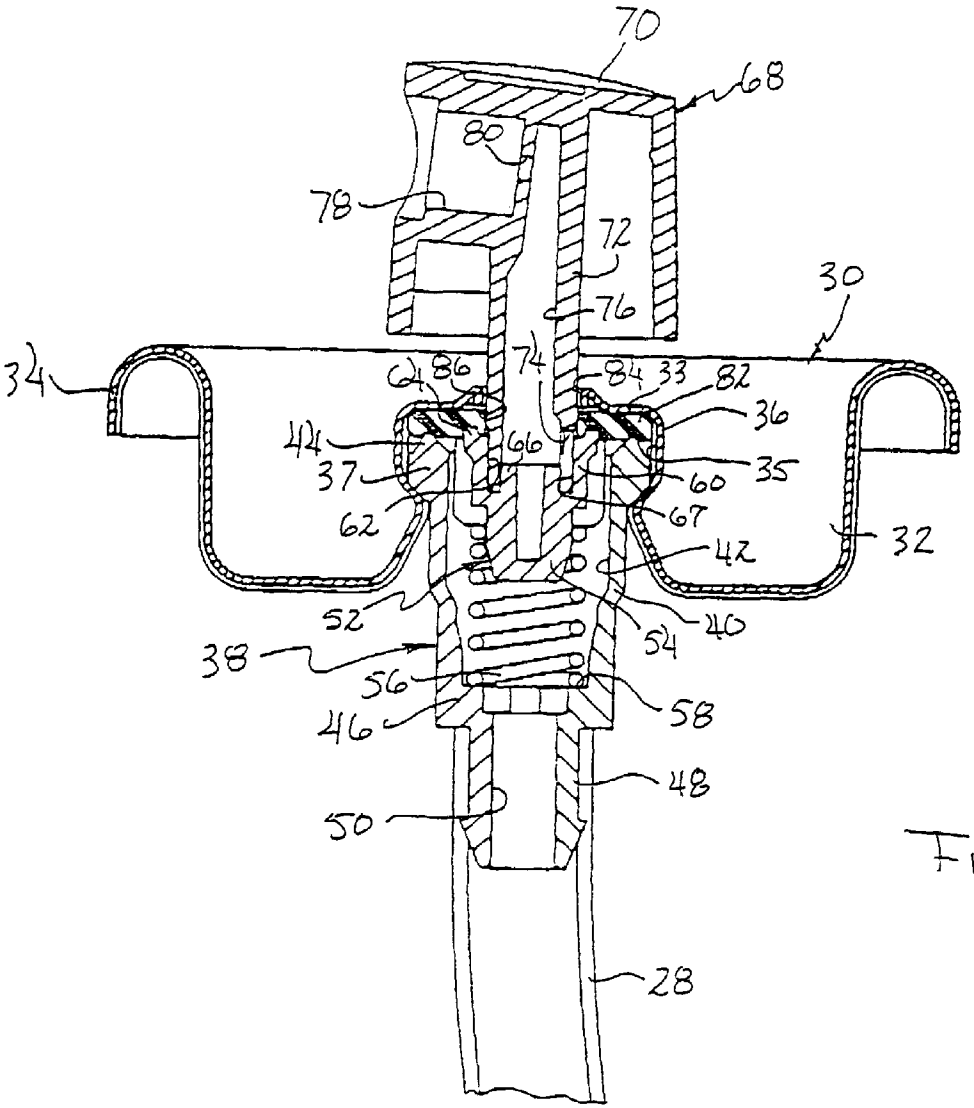
FIG. 2 is a cross-sectional view, drawn to an enlarged scale, of a valve assembly and associated components suitable for use in the system of FIG. 1 and embodying the present invention.

Turning now in detail to FIG. 2 of the drawings, a valve assembly of a construction that is somewhat different from that of FIG. 1 is illustrated and will be described in greater detail. More particularly, the valve assembly of FIG. 2 includes a closure member, generally designated by the numeral 30 (shown with an optional lining), which has a depending central portion 32 surrounded by a circumferential flange portion 34; the central portion 32 is constructed for seating in a circular opening of an aerosol container (such as the opening 14 in the top wall of the can 10 shown in FIG. 1), and the flange portion 34 is formed to engage a circumferential portion defining the container opening. An upstanding central part 36 of the cover member 30 is formed to define an inwardly opening recess 35, within which a circumferential shoulder portion 37 of a valve body, generally designated by the numeral 38, is seated and mechanically engaged, being locked in place by underlying surrounding structure of the cover member 30.

The valve body 38 has an upper end portion 40, defining a compound cavity 42, which is circumscribed by an inverted V-shape rim portion 44. A nipple element 48, having a passage 50 therethrough, extends from a lower end portion 46 of the body 38; it engages one end of the dip tube 28, and the passage 50 provides liquid flow communication with the cavity 42.

A throttle member, generally designated by the numeral 52, is slidably received in the cavity 42 in the valve body 38 and has a neck portion 54 about which one end of a coil spring 56 (typically made of hard-drawn stainless steel) is engaged; the opposite end of the spring is seated on the internal annular shoulder 58, formed at the intersection of the end portions 40, 46 of the body 38. An upstanding cylindrical sidewall 60, having a mouth that is circumscribed by an edge element 64, defines an upwardly opening cup-like recess 62 within the throttle member 52. A collar element 66 projects into the recess 62 coaxially with, and spaced slightly from, the wall 60 so as to define a surrounding circular groove 67.

The system depicted also includes an actuating spray head, generally designated by the numeral 68, comprised of a manual contact button 70 and a hollow stem portion 72; a short slot or orifice 74 extends axially from the lower end of the stem portion 72, and an axial passage 76 extends therethrough and communicates, through an aperture 80, with a nozzle insert seat 78 (the insert itself not being shown, but being of conventional form).

A conformable annular gasket 82 is seated within the recess 35 of the upstanding part 36 of the cover member 30. It serves both to produce a permanent seal between the overlying wall section 33 of the central part 36 and the rim portion 44 of the valve body 38, and also to engage circumferentially the outer surface of the stem portion 72 of the spray head 68 so as to produce a sliding seal. As can be seen, the stem portion 72 extends through a central hole 84 formed in the overlying wall section 33 and the aligned hole 86 through the gasket 82.

As depicted in FIG. 2 (as well as in FIG. 1), the valve assembly is in its closed position, the throttle member 52 being biased upwardly by the coil spring 56 so as to cause the circumferential edge element 64 at the mouth of the cylindrical wall 60 to seal against the underside of the gasket 82. Downward force upon the button 70 of the spray head 68 will of course be transmitted to the throttle member 52, so as to displace it from the gasket 82 and thereby permit the pressurized coating material to flow through the dip tube 28, into the passage 50 and cavity 42 of the valve body 38, through the short axial slot 74 in the stem portion 72, and finally through the passage 76 and aperture 80 into the nozzle insert seat 78, for discharge from the spray head.

It will be appreciated that the spray head 68 is readily removed from the female valve parts simply by withdrawing it, for replacement with a fresh head when its passages become clogged with material, as will inevitably occur when curing is initiated by atmospheric moisture (as in the case of RTV silicone materials). It will also be appreciated that, in operation, areas of the valve gasket will necessarily be contacted by the liquid coating material and also be exposed to the ambient moisture and thus be subjected to the conditions under which disabling deposits would normally be produced. In accordance with the present invention, however, it has been found that the use of a sealing element made from polyethylene, or from another synthetic resinous material that is substantially non-absorbing of moisture (in cooperation with other non-absorbing parts), significantly reduces this problem, or obviates it entirely, and thereby enables the system to remain functional for many months and throughout repeated cycles of spray discharge operation Thus it can be seen that the present invention provides a novel system for dispensing a moisture-curable coating material in the form of a spray, wherein and whereby curing of the material on elements of the system is substantially avoided so as to prevent disabling clogging and immobilization of moving parts. It more specifically provides an internally pressurized system for discharging, as an aerosol and in multiple cycles and/or after storage for an extended period of time, quantities of a moisture-initiated room-temperature vulcanizing rubber coating material. It should perhaps be emphasized that, while it is well known that light silicone liquids (used for example as lubricants) are commonly available in aerosol form, such materials do not cure to solid deposits and are fundamentally distinct from the coating materials to which the present invention is directed.

Having thus described the invention, what is claimed is:

1. A system for supplying a moisture-curable RTV silicone rubber coating material to a spray head, including:

a container having an interior, and an opening to the interior thereof;

a quantity of sprayable, moisture-curable RTV silicone rubber coating material contained within said container interior; and a valve assembly comprising:

a closure member associated with said opening of said container and having mounting structure thereon;

a valve body having an upper end portion defining a cavity extending downwardly from a rim portion thereof, and a lower end portion having a passage in flow communication with said cavity and said container interior, said mounting structure of said closure member being constructed for mounting said valve body, and said valve body being fabricated from a material that is substantially non-absorbing of moisture, and being attached to said closure member mounting structure with said rim portion disposed proximate an overlying section of said mounting structure;

a throttle member, fabricated from a material that is substantially non-absorbing of moisture, said cavity of said valve body being dimensioned and configured for seating said throttle member, and said throttle member being seated in said cavity of said valve body for movement between open and closed valve positions and having a sealing portion facing said overlying section of said mounting structure; and sealing means, fabricated from a conformable synthetic resinous material that is substantially non-absorbing of moisture, having a first portion interposed between said overlying section of said mounting structure of said closure member and said rim portion of said upper end portion of said valve body, for providing a permanent gas-tight seal therebetween, and a second portion disposed to engage said throttle member in said closed valve position for providing a temporary gas-tight seal between said overlying section of said mounting structure and said throttle member, said throttle member being spaced away from said sealing means in said open valve position to permit passage of said coating material from said container to a spray head.

2. The system of claim 1 wherein said non-absorbing synthetic resinous material from which said sealing means is fabricated has a Shore D Durometer value of about 20 to 55.

3. The system of claim 1 wherein said non-absorbing synthetic resinous material from which said sealing means is fabricated comprises polyethylene.

4. The system of claim 1 wherein said valve body and said throttle member are fabricated from at least one relatively rigid synthetic resinous material.

5. The system of claim 1 wherein said overlying section of said closure member mounting structure has an aperture therethrough for passage of a stem portion of an actuating spray head member into operative engagement with said throttle member for effecting movement thereof.

6. The system of claim 5 wherein said sealing means comprises a substantially annular gasket surrounding said aperture in said overlying section and dimensioned and configured to sealingly bear upon a said stem portion passing therethrough.

7. The system of claim 1 wherein said throttle member is slidably seated in said cavity of said valve body for movement between said open and closed valve positions.

8. The system of claim 7 wherein said valve assembly additionally includes a spring for biasing said throttle member to said closed valve position, and wherein said throttle member has a cup-like upper end portion, for seating the stem portion of an actuating spray head member, and a lower end portion for engaging said spring.

9. The system of claim 1 wherein said lower end portion of said valve body has means thereon for attaching a tube for delivery of said coating material to said passage thereof.

10. The system of claim 9 wherein said system additionally includes a tube, attached to said means for attaching on said valve body, for delivering said coating material to said passage in said lower end portion thereof, said tube being fabricated from a synthetic resinous material that is substantially non-absorbing of moisture.

11. The system of claim 5 wherein said system additionally includes a valve-actuating member comprising a spray head and a hollow stem portion in liquid flow communication with said spray head, said stem portion extending through said aperture in said mounting structure of said closure member and into operative engagement with said throttle member for effecting movement thereof away from said closed valve position toward said open position to permit the delivery of said coating material to said spray head through said valve body and said stem portion.

12. The system of claim 1 wherein said coating material is substantially devoid of moisture-absorbing components.

13. The system of claim 12 wherein said coating material is substantially clear.

14. A system for supplying a moisture-curable coating material to a spray head, including a container having an interior, and an opening to the interior thereof, and a valve assembly; said valve assembly comprising: a closure member associated with said opening of said container and having mounting structure thereon; a valve body, fabricated from a material that is substantially non-absorbing of moisture, having an upper end portion defining a cavity extending downwardly from a rim portion thereof, and a lower end portion having a passage in flow communication with said cavity and said container interior, said mounting structure of said closure member being constructed for mounting said valve body, and said valve body being attached to said closure member mounting structure with said rim portion disposed proximate an overlying section of said mounting structure; a throttle member, fabricated from a material that is substantially non-absorbing of moisture, said cavity of said valve body being dimensioned and configured for seating said throttle member, and said throttle member being seated in said cavity of said valve body for movement between open and closed valve positions and having a sealing portion facing said overlying section of said mounting structure; and sealing means, fabricated from a conformable synthetic resinous material that is substantially non-absorbing of moisture, having a first portion interposed between said overlying section of said mounting structure and said rim portion of said upper end portion of said valve body, for providing a permanent gas-tight seal therebetween, and a second portion disposed to engage said throttle member in said closed valve position for providing a temporary gas-tight seal between said overlying section of said mounting structure and said throttle member, said throttle member being spaced away from said sealing means in said open valve position.

15. The system of claim 14 wherein said non-absorbing synthetic resinous material from which said sealing means is fabricated has a Shore D Durometer value of about 20 to 55.

16. The system of claim 14 wherein said non-absorbing synthetic resinous material from which said sealing means is fabricated comprises polyethylene.

17. The system of claim 14 wherein said valve body and said throttle member are fabricated from at least one relatively rigid synthetic resinous material.

18. The system of claim 14 wherein said overlying section of said closure member mounting structure has an aperture therethrough for passage of a stem portion of an actuating spray head member into operative engagement with said throttle member for effecting movement thereof.

19. The system of claim 18 wherein said sealing means comprises a substantially annular gasket surrounding said aperture in said overlying section and dimensioned and configured to sealingly bear upon a said stem portion passing therethrough.

20. An internally pressurized system for dispensing moisture-curable RTV silicone rubber coating material, in the form of a spray, including:

a container having an interior, and an opening to the interior thereof;

a quantity of sprayable, moisture-curable RTV silicone rubber coating material, and a pressure-generating propellant, contained within said container interior;

a removable spray head actuating member, including a spray head disposed outwardly of said container, associated with said opening in said container;

a valve arrangement operatively interposed between said spray head and the interior of said container, said valve arrangement comprising:

a valve seat adjacent said opening of said container;

a throttle member having a sealing portion;

means for mounting said throttle member, for movement between open and closed valve positions, said throttle member being so mounted in said means for mounting with said sealing portion of said throttle member facing said valve seat for cooperation therewith; and sealing means, fabricated from a conformable synthetic resinous material, operatively disposed between said valve seat and said throttle member so as to engage said sealing portion of said throttle member in said closed valve position and thereby provide a temporary gas-tight seal to prevent passage of said coating material from said container interior to said spray head, said throttle member being spaced away from said valve seat in said open valve position, said spray head actuating member having an actuating element in operative engagement with said throttle member for effecting displacement thereof from said closed valve position to an open valve position to permit passage of said coating material from said container interior to said spray head, and all components of said valve arrangement that contact said coating material being fabricated from materials that are substantially non-absorbing of moisture.

21. The system of claim 20 wherein said non-absorbing synthetic resinous material from which said sealing means is fabricated has a Shore D Durometer value of about 20 to 55.

* * * * *